US005546921A

United States Patent [19]

Uchikawa

[11] Patent Number: 5,546,921

[45] Date of Patent: Aug. 20, 1996

[54] AIR-FUEL RATIO CONTROL SYSTEM

[75] Inventor: Akira Uchikawa, Atsugi, Japan

[73] Assignee: Unisia Jecs Corporation, Atsugi, Japan

[21] Appl. No.: 395,651

[22] Filed: Apr. 4, 1995

[30] Foreign Application Priority Data

Apr. 5, 1994 [JP] Japan ..... 6-067170

[51] Int. Cl.[6] ..... F02D 41/00

[52] U.S. Cl. ..... 123/694; 60/274

[58] Field of Search ..... 123/694, 691, 123/693; 364/431.05, 431.07; 60/276

[56] References Cited

FOREIGN PATENT DOCUMENTS 58-72647 4/1983 Japan .

*Primary Examiner*—Raymond A. Nelli

*Attorney, Agent, or Firm*—Foley & Lardner

[57] ABSTRACT

An air-fuel ratio control system for an internal combustion engine equipped with a three-way catalytic converter has first and second oxygen sensors disposed respectively upstream and downstream of the catalytic converter. An air-fuel ratio feedback correction coefficient is set in accordance with the output of the first oxygen sensor under a proportional plus integral control. The system has a control unit with a function to set a retard time in which the timing of a proportional control of air-fuel ratio control is compulsorily retarded, in accordance with the output of the second oxygen sensor. The retard time is limited within a range not longer than a maximum value set as a predetermined rate of an output cycle of the first oxygen sensor.

4 Claims, 5 Drawing Sheets

AIR-FUEL RATIO CONTROL SYSTEM

BACKGROUND OF THE INVENTION

1. Field of the Invention

This invention relates to improvements in an air-fuel ratio control system for an internal combustion engine, and more particularly to the air-fuel ratio control system arranged to accomplish an air-fuel ratio control in response to two kinds of air-fuel rations detected respectively upstream and downstream of a catalytic converter.

2. Description of the Prior Art

Most automotive vehicles are equipped with a three-way catalytic converter disposed in an exhaust system of an internal combustion engine for the purpose of purifying exhaust gas discharged from the engine. Hitherto, in such automotive vehicles, an air-fuel ratio control system has been used to feedback-control the air-fuel ratio of air-fuel mixture to be supplied to the engine at a stoichiometric value, thereby effectively maintaining a desired conversion efficiently of the three-way catalytic converter. The air-fuel ratio feedback control system includes an oxygen sensor (air-fuel ratio sensor) adapted to detect an oxygen concentration in exhaust gas, thereby obtaining an actual air-fuel ratio of the air-fuel mixture to be supplied to the engine. The oxygen sensor is usually located, for example, at a position where the branch runners of an exhaust manifold is gathered with each other in order to ensure a high response of the air-fuel ratio feedback control. In accordance with the oxygen concentration in exhaust gas detected by the oxygen sensor, the actual air-fuel ratio of the air-fuel mixture is detected as to whether it falls in lean or rich side relative to the stoichiometric air-fuel ratio, thereby feedback-controlling the amount of fuel to be supplied to the engine, thus diverging the air-fuel ratio into the stoichiometric air-fuel ratio.

However, the above oxygen sensor is located relatively close to the combustion chambers of the engine and therefore is exposed to high temperature exhaust gas. As a result, the oxygen sensor tends to change in its characteristics such as internal resistance, electromotive force, response time under its thermal deterioration or the like. Additionally, since exhaust gases from respective engine cylinders cannot be sufficiently mixed with each other, it is difficult to obtain an average air-fuel ratio for all of the engine cylinders. Consequently, the oxygen sensor does not accurately read the air-fuel ration, rendering unprecise air-fuel ratio control.

In view of the above, a variety of air-fuel ratio feedback control systems and methods using an additional oxygen sensor disposed downstream of the catalytic converter have been proposed to accomplish the air-fuel ratio feedback control under the action of two oxygen sensors as disclosed, for example, in Japanese Patent Provisional Publication No. 58-72647.

In the air-fuel ratio feedback control method of the Japanese Patent Provisional Publication, a correction processing for an amount of fuel to be supplied to the engine is accomplished with a retard time under an output inversion (inversion between the lean and rich sides of air-fuel ratio) of the oxygen sensor located upstream of the catalytic converter. Here, the retard time is changed in accordance with the output of the oxygen sensor located downstream of the catalytic converter, thereby correcting the characteristics of the air-fuel ratio feedback control depending upon the upstream side oxygen sensor toward the direction in which the air-fuel ratio detected by the downstream side oxygen sensor approaches the stoichiometric air-fuel ratio as a target air-fuel ratio.

Now, with the above conventional air-fuel ratio control method, there is a possibility of an air-fuel ratio feedback control point depending upon the upstream side oxygen sensor largely shifting from the target point under the characteristics change of the upstream side oxygen sensor, thereby prolonging the retard time. This prolonged retard time causes a control cycle depending upon the upstream side oxygen sensor to be disturbed, thereby resulting in an abrupt change in air-fuel ratio of the air-fuel mixture to be supplied to the engine, thus degrading the stability of engine operation.

Here, it is assumed that the engine operation stability is prevented from being degraded by limiting the retard time to a sufficiently short value with a predetermined fixed maximum value. However, there is a concern that an excessively short retard time will not improve the air-fuel ratio precision, even if the retard time has not affected the operational characteristics of the engine.

SUMMARY OF THE INVENTION

It is an object of the present invention to provide an improved air-fuel ratio control system for an internal combustion engine, which can effectively overcome drawbacks encountered in conventional air-fuel ratio control systems for an internal combustion engine.

Another object of the present invention is to provide an improved air-fuel ratio control system for an internal combustion engine, by which a high precision of an air-fuel ratio control can be obtained while securely preventing an engine operation stability from being degraded.

A further object of the present invention is to provide an improved air-fuel ratio control system for an internal combustion engine, in which an excessively short retard time for retarding a control response in air-fuel ratio feedback control is effectively avoided, thereby avoiding lowering of the precision of air-fuel ratio feedback control.

An air-fuel ratio control system of the present invention is for an internal combustion engine and, as shown in FIG. 1, comprises first and second air-fuel ratio sensors A1, A2 disposed respectively upstream and downstream of a catalytic converter disposed in an exhaust system of the engine. Each air-fuel ratio sensor produces an output value which changes in response to a concentration of a component in exhaust gas, which concentration changes in accordance with an air-fuel ratio of an air-fuel mixture to be supplied to the engine. An air-fuel ratio feedback control means A3 is provided to feedback-control an amount of fuel to be supplied to the engine in accordance with the output value of the first air-fuel ratio sensor so as to regulate the air-fuel ratio of the air-fuel mixture toward a target air-fuel ratio. Retard time setting means A4 is provided to set a retard time for which a control response in connection with an inversion between lean and rich sides of the air-fuel ratio relative to the target air-fuel ratio is retarded, in accordance with the output of the second air-fuel ratio sensor. Control response retarding means A5 is provided to compulsorily retard the control response in connection with the inversion between the lean and rich sides, in accordance with the retard time set by the retard time setting means. Maximum retard time setting means A6 is provided to set a maximum value of the retard time in accordance with a cycle of output of the first air-fuel ratio sensor. Additionally, retard time limiting means A7 is provided to limit the retard time set by the retard time setting means, in a range not longer than the maximum value of the retard time.

According to the air-fuel ratio control system, the amount of fuel to be supplied to the engine is feedback-controlled in accordance with the output of the first air-fuel ratio sensor disposed upstream of the catalytic converter, thus forming a target air-fuel mixture ratio. The control response at the inversion between the lean and rich sides relative to the target air-fuel ratio is compulsorily retarded in accordance with the retard time which is set according to the output of the second air-fuel ratio sensor disposed downstream of the catalytic converter, thus accomplishing a retard control. This retard control corrects the shift of an air-fuel ratio control point depending upon the first air-fuel ratio sensor. The retard time set according to the output of the second air-fuel ratio sensor is limited within the range not longer than the maximum value. Additionally, the retard time maximum value is set in accordance with the output cycle of the first air-fuel ratio sensor. In other words, the retard time maximum value changes in accordance with the output cycle of the first air-fuel ratio sensor. As a result, the effect of improving the precision of the air-fuel ratio control upon setting the retard time can be effectively obtained without causing the stability of engine operation to be deteriorated.

DETAILED DESCRIPTION OF THE INVENTION

Figure 1:
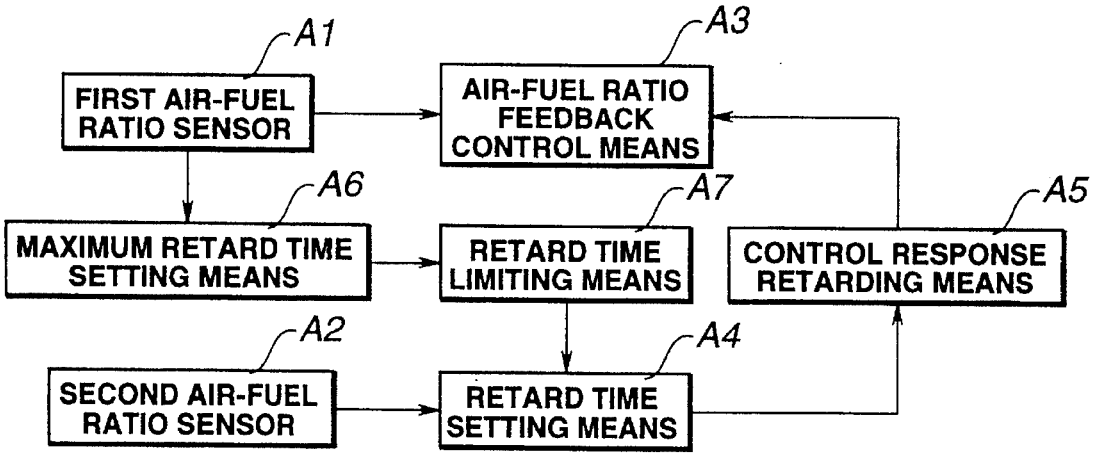
FIG. 1 is a block diagram illustrating the principle of the present invention.
Figure 2:
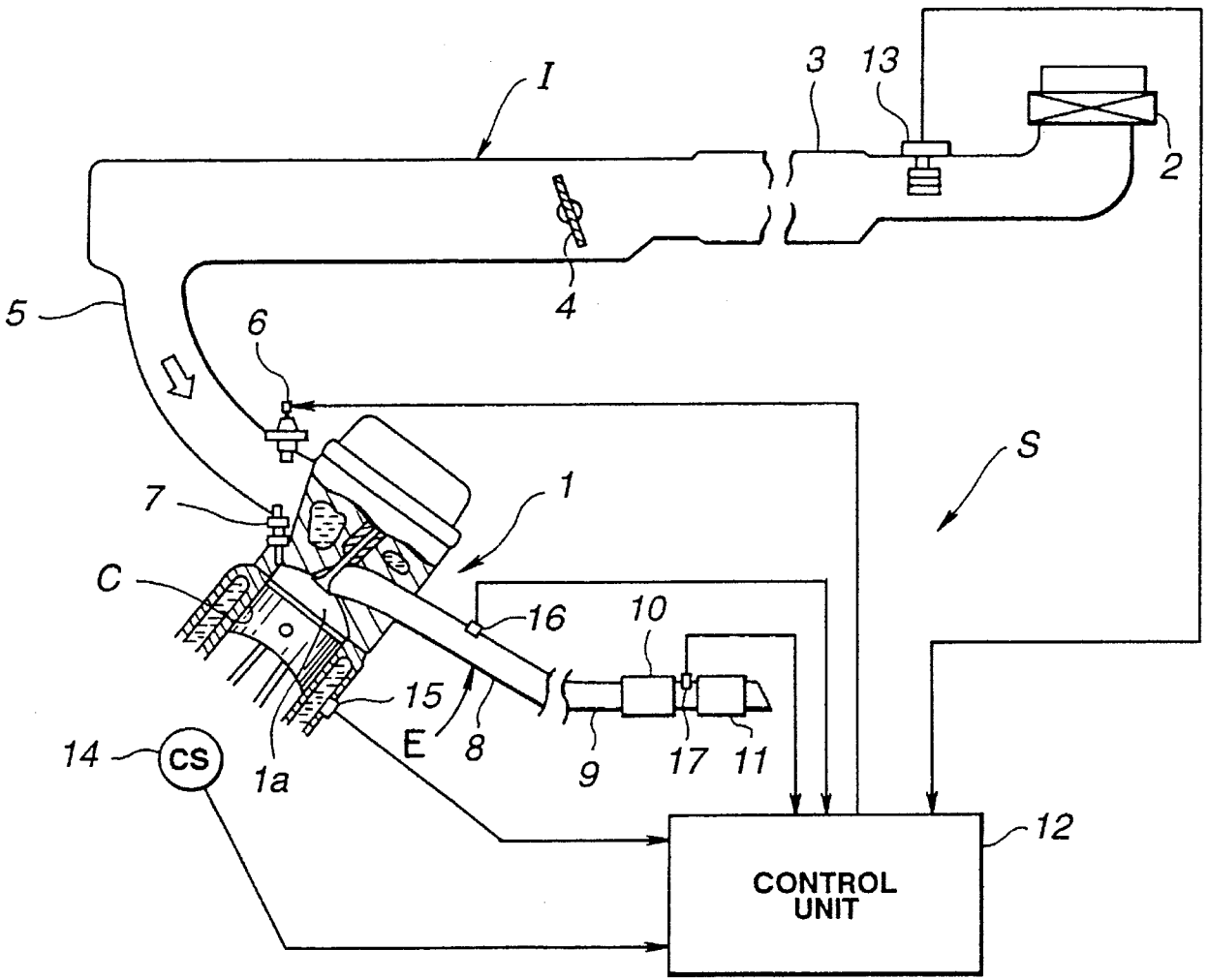
FIG. 2 is a schematic illustration of an embodiment of an air-fuel ratio control system according to the present invention.

Referring now to FIG. 2 of the drawings, an embodiment of an air-fuel ratio control system according to the present invention is illustrated by the reference character S. The air-fuel ratio control system S is for an internal combustion engine 1, which is, in this embodiment, of an automotive vehicle. The engine 1 is provided with an intake air passageway I through which intake air is inducted into combustion chambers (only one chamber shown). The intake air passageway I forms part of an intake system (not identified) and is formed through an air filter 2, an air intake duct 3 and an intake manifold 5. A throttle valve 4 is rotatably disposed in the intake air passageway I and located between the air intake duct 3 and the intake manifold 5.

A plurality of fuel injector valves 6 are disposed at the respective branch runners (not identified) of the intake manifold 5, which runners correspond respectively to engine cylinders C (only one cylinder shown) each of which includes the combustion chamber 1*a*. Each of the fuel injector valves 6 is an electromagnetically operated type and includes a solenoid (not shown) to operate a valve section (not shown). Accordingly, the fuel injector valve 6 is adapted to open upon supply of electric current to the solenoid and to close upon interruption of electric current supply to the solenoid. The supply of electric current is made by an injection pulse signal from a control unit 12, which will be discussed below.

The fuel injector valve 6 is supplied with fuel which is fed under pressure from a fuel pump (not shown) and regulated to a predetermined pressure by a pressure regulator (not shown). When the fuel injector valve 6 is opened, the fuel regulated in pressure is injected from the fuel injector valve 6 into the intake manifold 5, in accordance with the injection pulse signal. The injected fuel is mixed with intake air passing through the intake air passage I to form air-fuel mixture to be supplied to the combustion chambers 1*a*.

While the engine 1 incorporated with this embodiment of an air-fuel ratio control system has been shown and described as employing a so-called multiple-point injection (MPI) system including the plurality of fuel injector valves 6, it will be understood that it may employ a so-called single-point injection (SPI) system including a single fuel injector valve located, for example, upstream of the throttle valve 4.

A plurality of spark plugs 7 are disposed respectively to project respectively into the combustion chambers 1*a* so as to ignite the air-fuel mixture supplied to the combustion chambers 1*a*. Upon combustion of the air-fuel mixture, a piston (no numeral) is moved while producing exhaust gas.

The engine 1 is provided with an exhaust gas passageway E through which exhaust gas is discharged to ambient air. The exhaust gas passageway E, which forms part of an exhaust system (not identified), is formed through an exhaust manifold 8, an exhaust gas discharge duct 9, a three-way catalytic converter 10 having therein a three-way catalyst (not shown), and a muffler 11. The three-way catalyst is adapted to oxidize CO (carbon monoxide) and HC (hydrocarbons) and reduce NOx (nitrogen oxides) thereby converting them to harmless gases. The three-way catalyst is the highest in convention efficiency when the air-fuel mixture at a stoichiometric air-fuel ratio is combusted in the combustion chambers 1*a*.

The control unit 12 includes a microcomputer having a CPU, a ROM, a RAM, a A/D converter, an input and output interface, though not shown. The control unit 12 is adapted to input detection signals from a variety of sensors and make its processing operation to output control signals, which control the operation of the fuel injector valves 6, or more specifically, control the injection pulse signal from the control unit 12. The sensors include an air flow meter 13, a crank angle sensor 14, a coolant temperature sensor 15, a first oxygen sensor 16, and a second oxygen sensor 17.

The air flow meter 13 is of the so-called hot wire MAF (mass air flow) type or of the so-called movable flap or vane-type and disposed in the intake air duct 3 to output a voltage signal (as the detection signal) corresponding to a flow rate Q of intake air flowing through the intake air passageway I.

The crank angle sensor 14 is adapted to output a standard angle signal (as the detection signal) every standard crank angle or predetermined piston position, and a unit angle signal every unit crank angle. Here, an engine speed N can be calculated by measuring an output (generation) cycle of the above standard angle signal, or the frequency of output (generation) of the above unit angle signal within a predetermined time.

The coolant temperature sensor 15 is disposed to contact an engine coolant within a water or coolant jacket (no numeral) of the engine 1 and adapted to output the detection signal representative of an engine coolant temperature Tw.

The first oxygen sensor 16 is disposed inside a runner-gathering section (no numeral) of the exhaust manifold 8, at which the exhaust manifold branch runners are gathered with each other to be in contact with exhaust gas flowing through the exhaust manifold 8. The runner gathering section is located upstream of the three-way catalytic converter 10. The second oxygen sensor 17 is disposed in the exhaust gas discharge passage E and located at a position downstream of the three-way catalytic converter 10 and upstream of the muffler 11. Each of the first and second oxygen sensors 16, 17 is known as a sensor whose output value changes in response to the concentration of oxygen (as a specified component) in exhaust gas. Under the fact that the output value of the oxygen sensor abruptly changes on the opposite sides of the stoichiometric air-fuel ratio as a border, the oxygen sensor 16, 17 functions to output or develop a voltage (as the detection signal) around 1V when the air-fuel ratio of the air-fuel mixture to be supplied to the combustion chambers 1*a* is richer (in fuel) than the stoichiometric air-fuel ratio (i.e., low oxygen content in exhaust gas), and a voltage (as the detection signal) around 0V when the air-fuel ratio of the air-fuel mixture is leaner (in fuel) than the stoichiometric air-fuel ratio (i.e., high oxygen content in exhaust gas). Such development of voltages at the oxygen sensor 16, 17 is accomplished in accordance with the difference in concentration between atmospheric air (as a standard gas) and exhaust gas.

Here, the microcomputer in the control unit 12 includes a CPU, which has such an air-fuel ratio feedback correction control function (means) that controls the air-fuel ratio of the air-fuel mixture to be supplied to the combustion chambers 1*a* to the desired stoichiometric air-fuel ratio in accordance with the output of the first and second oxygen sensors 16, 17. In other words, a fuel injection (supply) amount from the fuel injector valve 6 is feedback-controlled to regulate the air-fuel ratio of the mixture to the stoichiometric air-fuel ratio. The fuel injection amount corresponds to the pulse width of the injection pulse signal from the control unit 12.

The air-fuel ratio feedback correction control basically consists of a proportional plus integral control that includes an integral control and a proportional control. In the integral control, judgment is made as to whether the air-fuel ratio of actual air-fuel mixture to be supplied to the combustion chambers 1*a* fall in a rich side or in a lean side relative to the stoichiometric air-fuel ratio. Where the mixture falls toward the lean side, an air-fuel ratio feedback correction coefficient $\alpha$ is gradually increased in accordance with an integral manipulated variable. Where the mixture falls toward the rich side, the air-fuel ratio feedback correction coefficient $\alpha$ is gradually decreased in accordance with the integral manipulated variable. In the proportional control, the air-fuel ratio feedback correction coefficient $\alpha$ is varied stepwise in accordance with a proportional manipulated variable at the inversion between the lean side and the rich side. It is to be noted that the air-fuel ratio feedback correction coefficient $\alpha$ has an initial value of 1.0 and is a correction item by which a basic fuel injection amount Tp is multiplied. The basic fuel injection amount Tp is the basic amount of fuel to be injected from the fuel injector valve 6 and corresponds to the basic pulse width of the injection pulse signal from the control unit 12.

Figure 4:
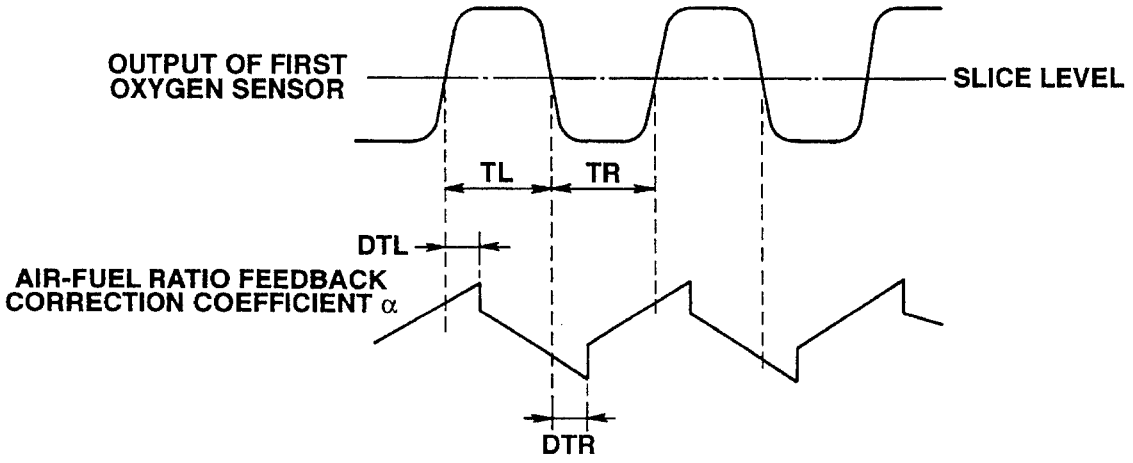
FIG. 4 is a time chart showing an air-fuel ratio control characteristics of the air-fuel ratio control system of FIG. 2.

In this embodiment, retard times DTR, DTL for compulsorily retarding an inversion of a manipulating direction (or an execution timing of the proportional control) due to the inversion between the lean and rich sides are set in accordance with the judgment of the actual air-fuel ratio falling in the lean or rich side relative to the target air-fuel ratio under the detection of the second oxygen sensor 17. A processing of retarding the air-fuel ratio feedback correction control is carried out in accordance with the retard times $DTR_1{}^3$ DTL. The retard time DTR is the retard time due to the inversion from the lean side to the rich side. The retard time DTL is the retard time due to the inversion from the rich side to the lean side as shown in FIG. 4.

More specifically, when the air-fuel ratio detected by the second oxygen sensor 17 is in the rich side relative to the stoichiometric air-fuel ratio, the retard time DTR is increased while the retard time DTL is decreased, so that a time period in which the air-fuel ratio feedback correction coefficient $\alpha$ is increased is shortened while a time period in which the air-fuel ratio feedback correction coefficient $\alpha$ is decreased is prolonged under the integral control. By this, the level of the air-fuel ratio correction coefficient $\alpha$ is compulsorily lowered, and therefore the air-fuel ratio feedback control is corrected in a direction that lowers the state of the rich side of the actual air-fuel ratio detected by the second oxygen sensor 17.

Next, a manner of control depending upon the output of the above second oxygen sensor 17 will be discussed with reference to a flowchart of FIG. 3.

Figure 3A:
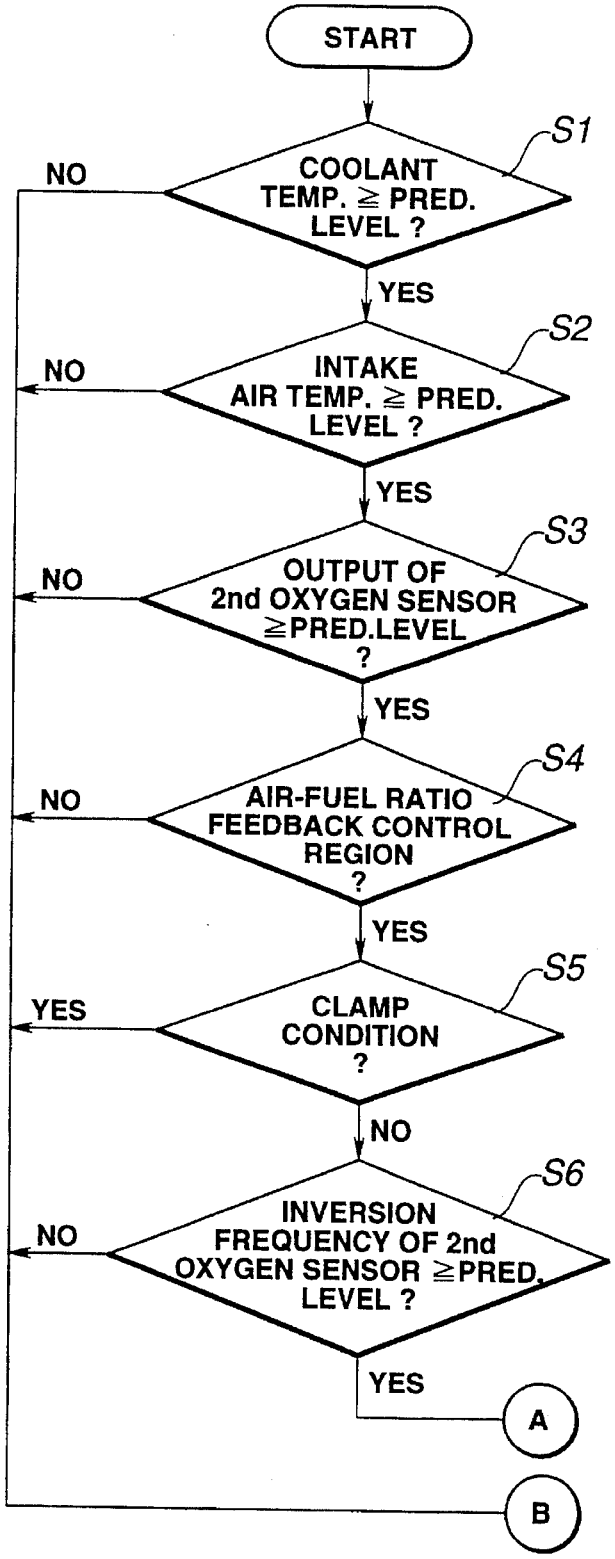
FIG. 3A is a former part of a flowchart showing a retarding processing executed by the air-fuel ratio control system of FIG. 2.
Figure 3B:
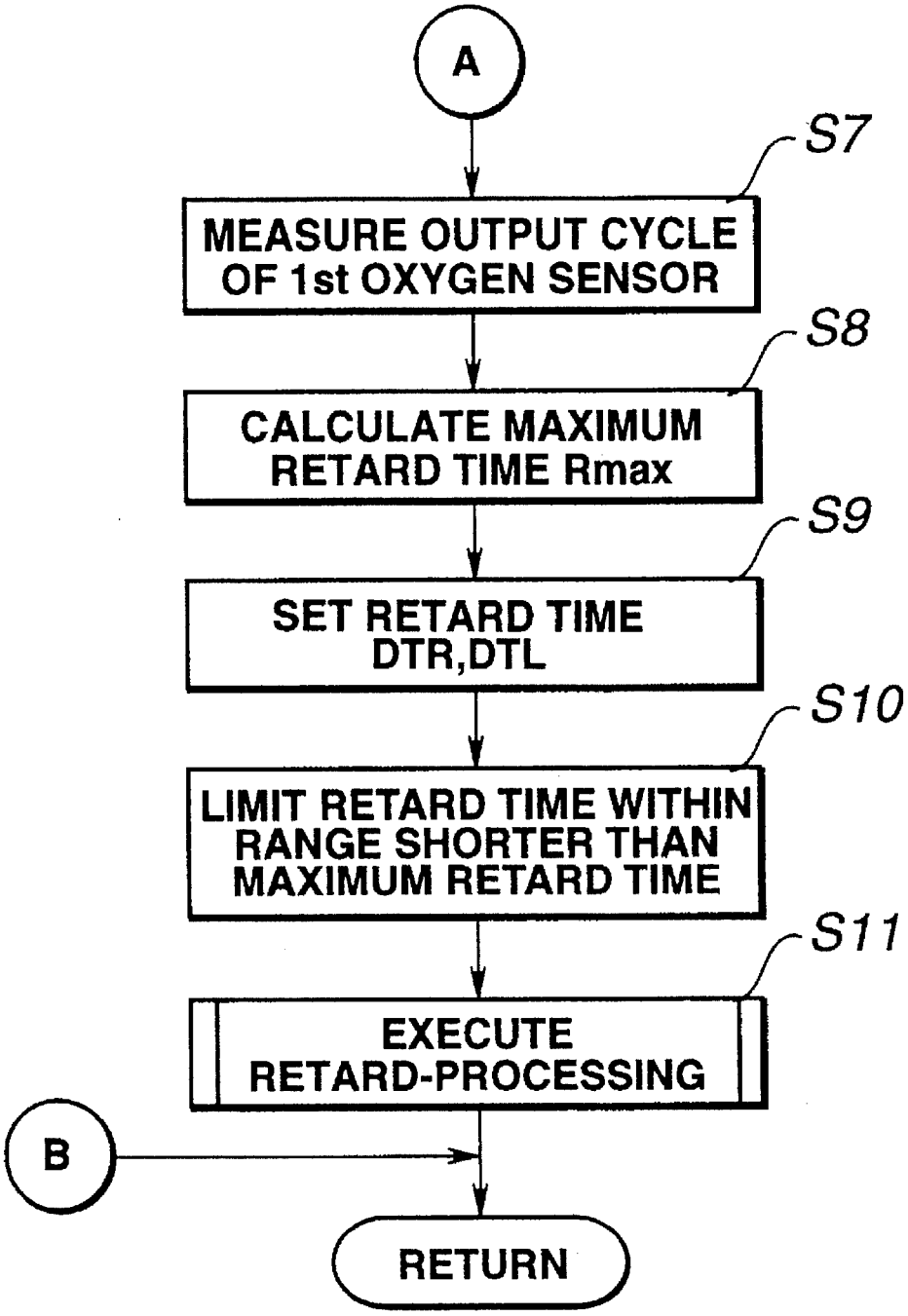
FIG. 3B is a latter part of the flow chart of FIG. 3A.

In the flowchart of FIG. 3, at steps S1 to S3, judgments are made as to whether or not the coolant temperature Tw is greater than or equal to a predetermined level (for example, 40° C.), an intake air temperature detected by an intake air temperature sensor (not shown) is greater than or equal to a predetermined level (for example, 25° C.), and the output of the second oxygen sensor 17 is greater than or equal to a predetermined level (for example, 800 mV). This judgment at the steps S1 to S3 indicates as to whether the second oxygen sensor 17 becomes active after an engine start. In other words, a rise in exhaust gas temperature (or in the temperature of the oxygen sensors) is presumed by the coolant temperature Tw and the intake air temperature. Additionally, a judgment is made as to whether the second oxygen sensor 17 is producing a predetermined output corresponding to the air-fuel ratio in the rich side, corresponding to a rich air-fuel combustion immediately after the engine start at which the amount of fuel supply to the engine is increased.

When the second oxygen sensor 17 has been judged to become active, a flow goes to step S4 at which a judgment is made as to whether an actual engine operating condition is within a predetermined engine operating region in which an air-fuel ratio feedback control is to be made. The predetermined engine operating region has been previously set in accordance with engine load and engine speed as parameters.

When the actual engine operating condition is within the predetermined engine operating region, the flow goes to step S5 at which a judgment is made as to whether the air-fuel ratio feedback control is in the state of being clamped under the established predetermined clamp condition. It is preferable that the predetermined clamp condition is established during a high load engine operation, an engine deceleration, an engine starting and the like.

In case that the result of the judgment represents that the air-fuel ratio feedback control is not in the clamped state, the actual engine operating condition corresponds to the air-fuel ratio feedback control region so that the air-fuel ratio feedback control (the proportional plus integral control of the air-fuel ratio feedback correction coefficient $\alpha$) is being actually carried out depending upon the output of the first oxygen sensor 16. Accordingly, the flow goes to step S6 at which a judgment is made as to whether the output (corresponding to the air-fuel ratio) of the second oxygen sensor 17 makes its inversion between the lean and rich sides by a frequency not less than a predetermined frequency after staring of the air-fuel ratio feedback control.

During the clamped state of the air-fuel ratio control, the amount of stored oxygen in the three-way catalyst of the catalytic converter 10 is in a saturated state or a state having an approximately zero oxygen content, owing to an oxygen storage effect of the three-way catalyst. Even if the air-fuel ratio feedback control is initiated from such a condition, there is a possibility that the air-fuel ratio inversion between the lean and rich sides concerning the second oxygen sensor 17 being extremely retarded under the action of the oxygen storage amount in the three-way catalyst, so that an over-correction will be made before occurrence of the air-fuel ratio inversion.

Consequently, after the outputs (corresponding to the lean and rich sides of the air-fuel ratio) of the second oxygen sensor 17 has been confirmed to be inverted by the frequency not less than the predetermined frequency, the correction control by the second oxygen sensor 17 is carried out thereby preventing the over-correction from arising immediately after the initiation of the air-fuel ratio feedback control.

In case that the outputs (corresponding to the lean and rich sides of the air-fuel ratio) of the second oxygen sensor 17 has been confirmed to be inverted by the frequency not less that the predetermined frequency at the step S6, the flow goes to step S7 at which a cycle of inversion of the outputs (corresponding to the lean and rich sides of the air-fuel ratios) of the first oxygen sensor 16 is measured. The inversion cycle includes a time TL in which the air-fuel ratio is inverted from the rich side to the lean side, and a time TR in which the air-fuel ratio is inverted from the lean side to the rich side as shown in FIG. 4.

At step S8, maximum values RLmax, RRmax of the retard times DTL, DTR are calculated and set according to the following equations, in accordance with the times TL, TR:

$$RLmax=TL\times K$$

$$RRmax=TR\times K$$

where K is a constant.

Subsequently, at step S9, the retard times DTL, DTR are set toward the direction in which the air-fuel ratio detected by the second oxygen sensor 17 approaches the stoichiometric air-fuel ratio, in accordance with the lean or rich side (relative to the stoichiometric air-fuel ratio) of the air-fuel ratio detected by the second oxygen sensor 17.

At step S10, the retard times DTL, DTR are respectively compared with the maximum values RLmax, RRmax. In case that the retard time DTL exceeds the maximum value RLmax, the maximum value RLmax is set as the retard time DTL. In case that the retard time DTR exceeds the maximum value RRmax, the maximum value RRmax is set as the retard time DTR. This prevents the retard times DTL, DTR exceeding the maximum values RLmax, RRmax from being set.

When the above processing of limiting the retard times DTL, LTR respectively within the maximum values RLmax, RRmax has been completed until the step S10, a processing of compulsorily retarding the timing (or a control response) of the proportional control at the inversion of the air-fuel ratio between the lean and rich sides, is executed in accordance with the retard times DTL, DTR at step S11.

Thus, according to the air-fuel ratio control system of this embodiment, the shift of an air-fuel ratio feedback control point depending upon the first oxygen sensor 16 is corrected by the retard processing using the retard times DTL, DTR which are set in accordance with the output of the second oxygen sensor 17, thereby ensuring a high air-fuel ratio control precision. Accordingly, convergency of the actual air-fuel ratio into the stoichiometric air-fuel ratio as the target air-fuel ratio can be effectively improved thus causing the three-way catalyst to exhibit its maximum conversion efficiency thereby improving the characteristics of exhaust gas.

Additionally, the retard times DTL, DTR are limited by the maximum values RLmax, RRmax, and therefore it can be prevented to set the retard times DTL, DTR at respective excessive long values. This effectively avoids a disturbance of the control cycle of the air-fuel ratio feedback control cycle and accordingly prevents the air-fuel ratio from abruptly changing, thus ensuring the stability in engine operation.

Furthermore, each of the maximum values RLmax, RRmax is not a fixed value and set as a predetermined (time) rate of the cycle of outputs (corresponding to the lean and rich sides of the air-fuel ratio) of the first oxygen sensor 16, and therefore the retard times DTL, DTR are prevented from being limited to excessively short values, thus effectively improving the precision of the air-fuel ratio control upon setting the retard times DTL, DTR.

Moreover, since the maximum value of the retard times is set not longer than the predetermined rate of the output cycle of the first oxygen sensor 16, the stability of the engine operation and the air-fuel ratio control can be highly compatible with each other thereby making it possible to set stably the maximum values of the retard times at a high precision.

What is claimed is:

1. An air-fuel ratio control system for an internal combustion engine, comprising:

first and second air-fuel ratio sensors disposed respectively upstream and downstream of a catalytic converter disposed in an exhaust system of the engine, each air-fuel ratio sensor producing an output value that changes in response to a concentration of a component in exhaust gas, which concentration changes in accordance with an air-fuel ratio of an air-fuel mixture to be supplied to the engine;

air-fuel ratio feedback control means for feedback-controlling an amount of fuel to be supplied to the engine in accordance with the output value of said first air-fuel ratio sensor so as to regulate the air-fuel ratio of the air-fuel mixture toward a target air-fuel ratio;

retard time setting means for setting a retard time where a control response in connection with an inversion between lean and rich sides of the air-fuel ratio relative to the target air-fuel ratio is retarded, in accordance with the output of said second air-fuel ratio sensor;

control response retarding means for compulsorily retarding the control response in connection with the inversion between the lean and rich sides, in accordance with said retard time set by said retard time setting means;

maximum retard time setting means for setting a maximum value of said retard time in accordance with a cycle of output of said first air-fuel ratio sensor; and retard time limiting means for limiting said retard time set by said retard time setting means, in a range not longer than said maximum value of said retard time.

2. An air-fuel ratio control system as claimed in claim 1, wherein each of said first and second air-fuel ratio sensors is adapted to produce first and second output values that are inverted in response to the concentration of oxygen in exhaust gas, which concentration changes in accordance with an air-fuel ratio of an air-fuel mixture to be supplied to the engine, wherein said air-fuel ratio feedback control means is adapted to feedback-control the amount of fuel to be supplied to the engine in accordance with the output value of said first air-fuel ratio sensor so as to regulate the air-fuel ratio of the air-fuel mixture toward a stoichiometric air-fuel ratio.

3. An air-fuel control system as claimed in claim 1, wherein said maximum retard time setting means includes means for setting the maximum value of said retard time as a predetermined rate of the output cycle of said first air-fuel ratio sensor.

4. An air-fuel ratio control system as claimed in claim 2, wherein said maximum retard time setting means includes means for setting said maximum value of said retard time in accordance with a cycle of inversion of said first and second output values of said first air-fuel ratio sensor.

* * * * *